United States Patent [19]

Kinzer

[11] 4,343,372

[45] Aug. 10, 1982

[54] GAGE ROW STRUCTURE OF AN EARTH BORING DRILL BIT

[75] Inventor: Donald L. Kinzer, Houston, Tex.

[73] Assignee: Hughes Tool Company, Houston, Tex.

[21] Appl. No.: 161,701

[22] Filed: Jun. 23, 1980

[51] Int. Cl.[3] ..... E21B 10/52

[52] U.S. Cl. ..... 175/374; 175/410

[58] Field of Search ..... 175/374, 375, 410

[56] References Cited

U.S. PATENT DOCUMENTS

| | | | |
|---|---|---|---|
| 2,990,025 | 6/1961 | Talbert et al. | 175/375 |
| 3,126,067 | 3/1964 | Schumacher | 175/374 |
| 4,056,153 | 11/1977 | Miglierini | 175/374X |

*Primary Examiner*—Ernest R. Purser

*Attorney, Agent, or Firm*—Robert A. Felsman; James E. Bradley

[57] ABSTRACT

An earth boring drill bit has staggered rows of wear resistant inserts that are positioned to provide more inserts in the rows without sacrificing insert supporting metal. The staggered rows include a first or heel row of inserts that is positioned next to the gage surface of the cutter. The second or adjacent row is located farther from the gage surface and staggered with the first row so that the first and second row inserts alternate in contacting the bottom of the borehole. Each insert has a centerline that intersects the cutter axis. The first row inserts intersect the cutter axis at a greater angle than the second row inserts. This positioning results in a more uniform section of metal between the holes of the first and second row inserts, enabling a closer spacing.

3 Claims, 10 Drawing Figures

GAGE ROW STRUCTURE OF AN EARTH BORING DRILL BIT

BACKGROUND OF THE INVENTION

1. Field of the Invention

This invention relates in general to earth boring drill bits, and in particular to the positioning of wear resistant inserts on the cutters.

2. Description of the Prior Art

Earth boring bits for drilling oil and gas wells typically have three rolling cutters that roll over the bottom of the borehole as the bit rotates. Each cutter is generally conical and has a gage surface that contacts the borehole wall as the cutter rotates. One type of bit has wear resistant inserts secured in holes in the cutters. The inserts are arranged in circumferential rows at various distances from the gage surface.

Certain cutters have a gage row structure that includes staggered rows located next to the gage surface. The staggered rows comprise two rows of inserts alternately spaced so that the inserts of one row alternately contact the borehole bottom with the inserts of the other row. Often, the inserts of the staggered rows are spaced as closely as possible to each other to provide as many inserts as is possible for a selected cutter diameter. The minimum distance between inserts is limited by the necessary amount of cutter support metal between inserts.

SUMMARY OF THE INVENTION

It is a general object of this invention to provide an improved earth boring drill bit.

It is a further object of this invention to increase the number of inserts in staggered rows for a selected cutter diameter, without sacrificing necessary support metal.

In accordance with these objects, a cutter is provided with staggered rows next to the gage surface. A first row is located next to the gage surface, and a second row is staggered with the first row and located farther from the gage surface. The inserts are positioned so that the supporting metal between each second row insert and each first row insert is more uniform than in the prior art. In the preferred embodiment, all of the inserts intersect the cutter axis. The angle of intersection of the first row inserts is greater than the angle of intersection of the second row inserts.

With this orientation, the distance between first and second row inserts at their bases is only slightly less than the distance between the inserts at the cutter surface. This allows a larger number of inserts for a given diameter than with the prior art orientations.

DESCRIPTION OF THE PREFERRED EMBODIMENT

Figure 1:
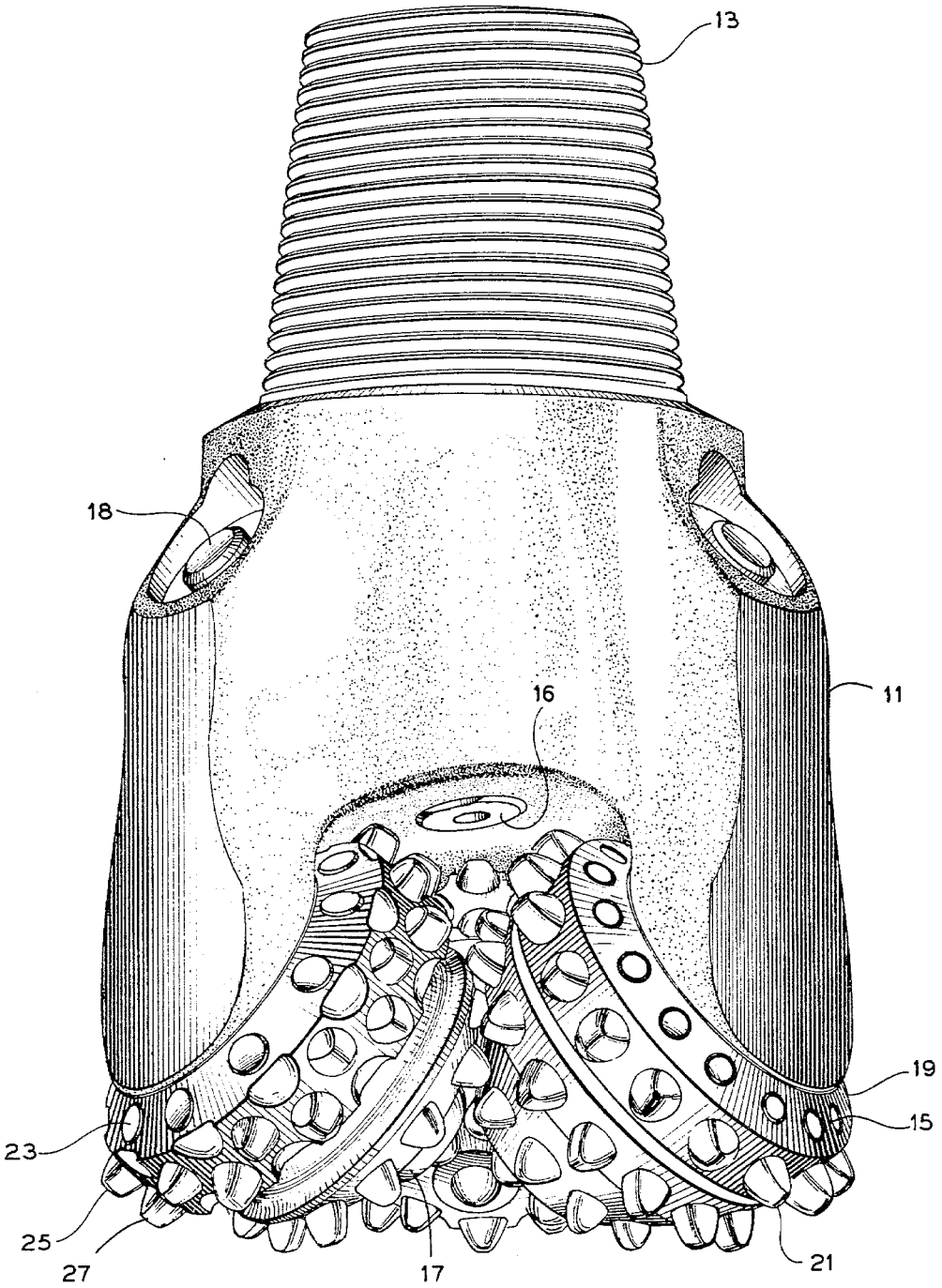
FIG. 1 is a perspective view of an earth boring drill bit constructed in accordance with this invention.

Referring to FIG. 1, drill bit 11 has a threaded section 13 on its upper end for securing to a string of drill pipe. Three cutters 15 are rotatably mounted on depending bearing pins (not shown). Three nozzles 16 (only one shown) serve to discharge drilling fluid pumped down the drill pipe. A pressure compensator system 18 for each cutter 15 serves to reduce pressure differential between the borehole fluid and lubricant in the bearings of the cutters 15.

Each cutter 15 is generally conically shaped with a nose area 17 at the apex of the cone and a gage surface 19 at the base of the cone. The gage surface 19 is frustoconical and is adapted to contact the wall of the borehole as the cutters 15 rotate about the borehole bottom. Each cutter 15 has a plurality of wear resistant inserts 21 interferingly secured in mating holes drilled in the supporting surface of the cutter 15. Preferably the inserts 21 are constructed from sintered tungsten carbide. Also, each cutter 15 has a plurality of wear resistant gage inserts 23 secured in the gage surface 19 to reduce wear on the gage surface.

Inserts 21 are located in rows that extend circumferentially around the generally conical surface of the cutters 15. Certain of the rows are arranged to intermesh with other rows of other cutters 15. One or two of the cutters have staggered rows consisting of a first row 25 of inserts and a second row 27 of inserts. First or heel row 25 is a circumferential row that is the row closest to the edge of the gage surface 19. There are no inserts any closer to the gage surface 19 than the inserts of row 25.

Second or adjacent row 27 is a circumferential row that is located next to first row 25 and farther from the gage surface 19 than the first row 25. There are no inserts between the first and second rows 25 and 27. The inserts of the first row 25 and the second row 27 are alternately spaced so that an insert of the first row 25 alternates in contacting the borehole bottom with an insert of the second row 27. Stated in another manner, if radial planes were passed through the axis of cutter 15 and through each insert of first row 25 and each insert of row 27, the radial planes would alternate. A radial plane passing through an insert of the first row 25 would alternate with a radial plane passing through an insert of second row 27.

Figure 2A:
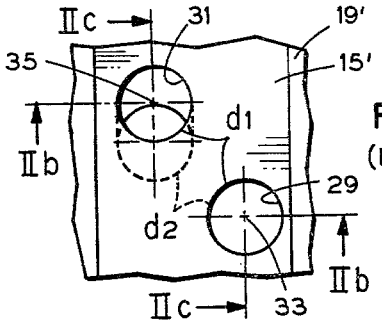
Fig. 2a (PRIOR ART)
FIG. 2*a* is a partial side view of a prior art cutter, illustrating two insert holes.
Figure 2B:
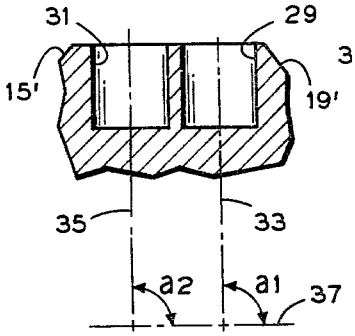
Fig. 2b (PRIOR ART)
FIG. 2*b* is a sectional view of the cutter of FIG. 2*a*, taken along the lines IIB—IIB of FIG. 2*a*.
Figure 2C:
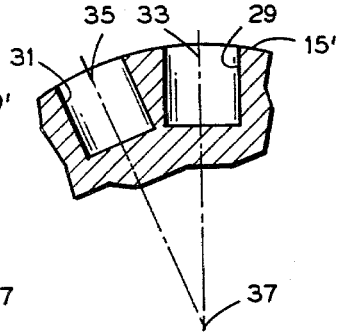
Fig. 2c (PRIOR ART)
FIG. 2*c* is a sectional view of the cutter of FIG. 2*a*, taken along the lines IIc—IIc of FIG. 2*a*.

The description of the preferred embodiment up to this point would apply equally to the prior art as well as to the cutter 15 of this invention. The differences from the prior art can best be ascertained by referring to FIGS. 2–4. FIG. 2*a* is a side view of a fragment of a prior art cutter 15'. It contains a first row of holes 29 located next to the gage surface 19' and corresponding to the first insert row 25 (FIG. 1). A second row of holes 31 is spaced inward from the gage surface 19, this row corresponding to the second row 27 (FIG. 1). As shown in the sectional view (FIG. 2*c*), each hole 29 and 31 is drilled so that its longitudinal axis or centerline 33 and 35, respectively, intersects the cutter axis 37. As shown in FIG. 2*b*, centerline 33 intersects cutter axis 37 at an angle a1. Centerline 35 intersects the cutter axis 37 at an angle a1 that is identical to angle a2. Angles a1 and a2 may be perpendicular to cutter axis 37, or they may be slightly acute or obtuse.

As seen in FIG. 2*b*, the identical angles a1 and a2 result in the distance d1 between holes 29 and 31 at their tops being considerably greater than the distance d2 between the holes 29 and 31 at the bases of the holes. A minimum distance d2 is required to provide the necessary supporting metal around each insert hole 29 and 31.

Figure 3A:
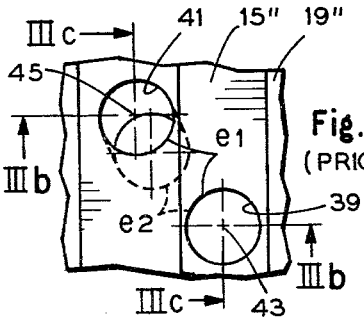
Fig. 3a (PRIOR ART)
FIG. 3*a* is a partial side view of another prior art cutter, illustrating two insert holes.
Figure 3B:
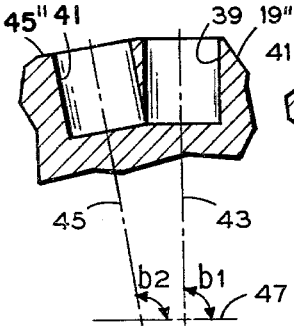
Fig. 3b (PRIOR ART)
FIG. 3*b* is a sectional view of the cutter of FIG. 3*a*, taken along the lines IIIb—IIIb of FIG. 3*a*.
Figure 3C:
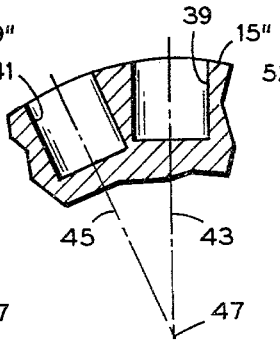
Fig. 3c (PRIOR ART)
FIG. 3*c* is a sectional view of the cutter of FIG. 3*a*, taken along the lines IIIc—IIIc of FIG. 3*a*.

FIGS. 3*a*, 3*b* and 3*c* illustrate a second prior art approach. A first row of holes 39 is located adjacent the gage surface 19" of the cutter 15") this row corresponding to the first insert row 25 (FIG. 1). A second row of holes 41 is located inward and staggered from the first row of holes 39, this second row corresponding to the second row 27 of FIG. 1. As in the prior art cutter 15' of FIGS. 2*a*–2*c*, the first and second rows 39 and 41 have centerlines 43 and 45, respectively, that are contained within radial planes of the cutter axis 47, as indicated in the sectional view of FIG. 3*c*. As shown in FIG. 3*b*, centerline 43 intersects cutter axis 47 at an angle b1. Centerline 45 intersects cutter axis 47 at an angle b2 that is slightly greater than angle b1. Angle b1 may be perpendicular to cutter axis 47 or slightly obtuse or acute.

As indicated by the dotted lines in FIG. 3*a*, this orientation also results in a section of supporting metal between the two holes 39 and 41 that has a greater distance e1 at the top of the holes than the distance e2 at the bottom of the holes.

Figure 4A:
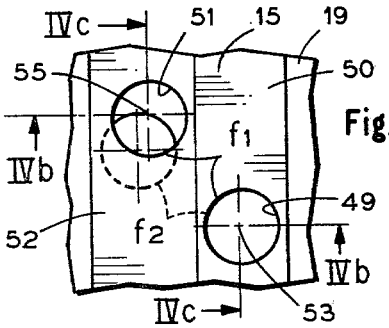
FIG. 4*a* is a partial side view of a cutter constructed in accordance with this invention, illustrating two insert holes.
Figure 4B:
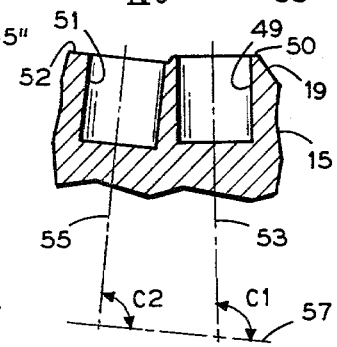
FIG. 4*b* is a sectional view of the cutter of FIG. 4*a*, taken along the lines IVb—IVb of FIG. 4*a*.
Figure 4C:
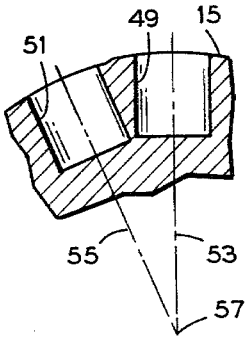
FIG. 4*c* is a sectional view of the cutter of FIG. 4*a*, taken along the lines IVc—IVc of FIG. 4*a*.

The preferred embodiment, shown in FIGS. 4*a*–4*c*, differs in the positioning of the holes for the first and second rows 25 and 27 of inserts, this difference allowing a greater number of inserts to be placed in this area. Referring to FIG. 4*a*, a first row of holes 49 is located in an annular band 50 formed around the circumference of the supporting surface of the cutter 15 next to the gage surface 19. Holes 49 are drilled normal to the band 50. These holes receive the first or heel row inserts 25. A second or adjacent row of holes 51 is located farther from the gage surface 19 in an annular band 52 and staggered with the first row of holes 49, as previously discussed. Holes 51 are drilled normal to band 52. The second row holes 51 receive the inserts 27 of the second row, as seen in FIG. 1.

The centerlines 53 and 55 of the holes 49 and 51, respectively, are located in radial planes of the cutter axis 57, as seen in FIG. 4*c*. Also, as shown in FIG. 4*b*, all of the centerlines 53 are located from gage surface 19 less than the diameter of holes 49. All of the centerlines 55 are located farther from gage surface 19 than centerlines 53 by an amount less than twice the diameter of holes 49, 51, these diameters being equal.

As shown in FIG. 4*b*, centerline 53 intersects the cutter axis 57 at an angle c1. Centerline 55 intersects the cutter axis 57 at an angle c2 that is less than the angle c1 by a range from 1° to 10°. In the preferred embodiment; angle c1 is an obtuse angle of 94°, while angle c2 is 90°. Annular band 50 is thus formed at an angle of 4° with respect to cutter axis 57, and annular band 52 is cylindrical. Angles c1 and c2 are measured counterclockwise from cutter axis 57.

When the cutter 15 is rotated about cutter axis 57, centerlines 55 generate an imaginary surface of revolution that is a plane perpendicular to cutter axis 57. During cutter 15 rotation, centerlines 53 generate an imaginary surface of revolution that is a cone with the apex at cutter axis 57. The distance between these two surfaces of revolution is greater at cutter axis 57 than at the tops of holes 49 and 51. The surfaces of revolution converge or intersect at a point exterior of cutter 15.

As shown by the dotted lines in FIG. 4*a*, making angle c2 less than angle c1, results in a distance f1 at the top of the holes 49 and 51 that is only slightly greater than the distance f2 between the bases of the holes 49 and 51. The distance f1 is the distance between the sidewalls of the holes 49 and 51, measured in a straight line drawn between centerlines 53 and 55 at the tops of the holes. The distance f2 is the distance between the sidewalls of holes 49 and 51, measured in a straight line at the bases of the hole. The more uniform thickness of the section of supporting metal between the two holes 49 and 51 allows more holes to be drilled around the circumference of a cutter 15 than in the known prior art cutters 15' and 15" of FIGS. 2 and 3.

For illustration purposes, the distances d1, e1, and f1 are all shown to be approximately equal to each other. However, the distance between bases d2, e2, and f2 all differ, with the distance f2 being appreciably greater than the distances d2 and e2. If the distance e2 were assumed to be the minimum, and if the distance f2 were constricted to the minimum distance e2, then the distance f1 would correspondingly decrease. This results in providing space for more holes on the surface of the cutter 15. In a cutter having a diameter of 3,579 inches at annular band 50, positioning the holes 49 and 51 as shown in FIG. 4, results in seventeen holes 49 and 51 each. For the same diameter cutter, positioning the holes as in FIGS. 2 and 3, resulted in only fourteen holes in each of the first and second rows. In another comparison, assuming uniform depths for the insert holes, the ratio of d2 over d1 is about 0.5; the ratio e2 over e1 is about 0.455; and the ratio f2 over f1 is about 0.860.

In operation, referring to FIG. 1, the bit 11 is secured to a string of drill pipe and rotated about the axis of the drill pipe. Each cutter 15 rotates about its own axis during bit rotation. The inserts 21 disintegrate the earth formation as they contact the borehole bottom.

The invention has significant advantages. In the prior art the second row intersected the cutter axis at the same angle as the first row or at a greater angle. This caused the distance between the insert holes at the top to be much greater than the distance between the insert holes at the bases. By causing the axis of the second row inserts to intersect the cutter axis at a lesser angle than the angle at which the first row intersects the cutter axis, the distance between the insert holes at the top and at the bases becomes more uniform, enabling more inserts to be placed around the cutter.

While the invention has been shown in only one of its forms, it should be apparent that it is not so limited, but is susceptible to various changes and modifications.

I claim:

1. In a rolling cutter of an earth boring drill bit having a gage surface adapted to contact the sidewall of a borehole as the cutter rotates about its axis and rolls over the bottom of the borehole, the improvement comprising in combination:

first and second rows of inserts positioned adjacent each other on the cutter next to the gage surface, the second row inserts being positioned farther from the gage surface than the first row inserts and staggered so that the first and second row inserts alternate in contacting the bottom of the borehole;

each first row insert having a cylindrical base with a centerline that intersects the cutter axis at a selected angle c1;

each second row insert having a cylindrical base with a centerline that intersects the cutter axis at a selected angle c2 that is less than the angle c1.

2. In an earth boring drill bit having a plurality of cutters, each mounted for rotation about a cutter axis, each cutter having a generally frusto-conical supporting surface, and a gage surface for rolling contact with the sidewall of a borehole as the cutter rolls over the bottom of the borehole, the improvement comprising in combination:

first and second rows of inserts positioned in the supporting surface next to each other and next to the gage surface, the first and second row inserts being staggered so that each second row insert alternates with a first row insert in contacting the bottom of the borehole;

each first row insert and second row insert having a cylindrical base with a centerline that intersects the cutter axis;

each of the centerlines, when the cutter is rotated about the cutter axis, defining a surface of revolution, the distance between the surfaces of revolution at the cutter axis being more than the distance between the surfaces of revolution at the supporting surface of the cutter.

3. In a rolling cutter of an earth boring drill bit having a gage surface adapted to contact the sidewall of a borehole as the cutter rotates about its axis and rolls over the bottom of the borehole, the improvement comprising in combination;

first and second rows of inserts positioned on the cutter next to the gage surface, all of the first row inserts being positioned an equal distance from the gage surface, all of the second row inserts being an equal distance from the gage surface and being farther from the gage surface than the first row inserts, the first and second row inserts being staggered so that the first and second row inserts alternate in contacting the bottom of the borehole;

each of the first row inserts having a cylindrical base with a centerline that defines a surface of revolution as the cutter is rotated;

each of the second row inserts having a cylindrical base with a centerline that defines a surface of revolution as the cutter is rotated;

the first and second row inserts being oriented so that the surface of revolution of the first row inserts intersects the surface of revolution of the second row inserts exterior of the cutter.

* * * * *

UNITED STATES PATENT OFFICE

CERTIFICATE OF CORRECTION

Patent No. 4,343,372 Dated August 10, 1982

Inventor(s) Donald L. Kinzer

It is certified that error appears in the above-identified patent and that said Letters Patent are hereby corrected as shown below:

At column 4, line 30, "3,579" should be --3.579--.

Signed and Sealed this

Ninth Day of November 1982

[SEAL]

*Attest:*

GERALD J. MOSSINGHOFF

*Attesting Officer* *Commissioner of Patents and Trademarks*